US012806497B1

(12) United States Patent
Vivirito

(10) Patent No.: US 12,806,497 B1
(45) Date of Patent: Nov. 24, 2026

(54) COURSE-BASED TOSS SKILL GAME

(71) Applicant: Joseph Vivirito, Valencia, PA (US)

(72) Inventor: Joseph Vivirito, Valencia, PA (US)

( * ) Notice: Subject to any disclaimer, the term of this patent is extended or adjusted under 35 U.S.C. 154(b) by 487 days.

(21) Appl. No.: 18/492,137

(22) Filed: Oct. 23, 2023

Related U.S. Application Data

(60) Provisional application No. 63/380,750, filed on Oct. 24, 2022.

(51) Int. Cl.
*A63B 67/06* (2006.01)
*A63B 71/06* (2006.01)

(52) U.S. Cl.
CPC ..... *A63B 67/06* (2013.01); *A63B 71/0672* (2013.01)

(58) Field of Classification Search
CPC ..... A63B 67/06; A63B 2067/063; A63B 71/0672
See application file for complete search history.

(56) References Cited

U.S. PATENT DOCUMENTS

| | | | | |
|---|---|---|---|---|
| 3,671,042 | A * | 6/1972 | Garber | A63B 69/3691 473/165 |
| 4,068,972 | A * | 1/1978 | Stuart | A63B 71/0672 116/222 |
| 7,488,260 | B2 * | 2/2009 | Moorehead | A63B 67/02 473/173 |
| 2014/0091525 | A1 * | 4/2014 | Ramirez | A63B 63/08 273/402 |

* cited by examiner

*Primary Examiner* — Brian O Peters
(74) *Attorney, Agent, or Firm* — Karen Tang-Wai Sutton

(57) ABSTRACT

A new toss-skill game using a toss-object such as a beanbag and having a set course apportioned into a series of play holes with each play hole having a start and a finish, with a first toss box positioned at the start and a target on a raised platform positioned at the finish and one or more additional toss boxes positioned between the first toss box and the target. A plurality of obstacles are positioned on the course designed to interfere with a line of sight from the toss boxes to the target. The toss-object is a handheld object with a flexible body typically filled with one or a combination of gel, water, sand, beads or beans. A method of play is also provided.

11 Claims, 11 Drawing Sheets

COURSE-BASED TOSS SKILL GAME

CROSS-REFERENCE TO RELATED APPLICATIONS

This application claims priority from U.S. provisional application Ser. No. 63/380,750 filed on 24 October, whose disclosure in its entirety is hereby incorporated by this reference.

STATEMENT REGARDING FEDERALLY SPONSORED RESEARCH OR DEVELOPMENT

NA

NAMES OF THE PARTIES TO A JOINT RESEARCH AGREEMENT

NA

INCORPORATION BY REFERENCE OF MATERIAL SUBMITTED ON A COMPACT DISC OR AS A TEXT FILE VIA THE EFS WEB SYSTEM

NA

STATEMENT REGARDING PRIOR DISCLOSURES BY THE INVENTOR OR A JOINT INVENTOR

NA

BACKGROUND OF THE INVENTION

Field of the Invention

The invention pertains to the field of toss skill games, specifically, a new toss skill game with a dedicated course combining common golf terms with elements of other toss skill games.

Background Art

Recreation is an important feature of our daily lives, and many cultures and societies have created and enjoyed a variety of skill games over the centuries. Most outdoor recreational games involve some type of skill combined with a competitive feature, such as two people playing tennis, with a winner and a loser. The level of skill required to play these games varies; some games have low skill requirements, such as ring toss, and others, notably golf and basketball, require high level skills that often require lessons and many years of practice and training.

Toss skill games, such as cornhole, ring toss, frisbee, and other games are among the most popular relatively low skill-based games for casual play by people of all ages. These games however are mostly "backyard games" that are fun during a family get together or barbeque but are not suitable as "destination" activities that people are willing to pay for because they are simple and ubiquitous. Golf is the opposite of these skill-toss games: a difficult, skill-based game, not readily accessible to anyone except those who play regularly and who take lessons to improve their skills, and whose courses are expensive and highly sought after. Many vacations are planned around golf play and courses are specifically designed to attract players of varying skills who are willing pay for the experience of playing on these unique courses and the bragging rights that go with them.

Despite its relatively young age, the game of golf remains one of the most popular high-skill games that attracts interest from those of all golf-skill levels. The problem with golf however is that because it is so highly skilled, casual players are not welcomed on golf courses, as they slow down the play of better players. Casual players often lack the strength to hit the ball long distances, and losing the ball in rough greens is not fun for any player.

Golf also provides many challenges to the golf course owner. Large courses require acquisition of a relatively large amount of land and significant resources to install, operate, and maintain.

The desire to make golf more accessible to the casual player and more easily owned and operated by the golf course owner resulted in the game of miniature golf. The first commercial mini golf course opened in the US in 1961, and it remains a favorite game of all ages.

While popular with players, miniature golf course owners face many unique problems providing and maintaining such courses. For mini golf, as in regular golf, it is important that the play speed be maintained, to prevent slow groups from delaying all other playing groups. Hence, most mini golf courses have rules related to the maximum number of strokes allowed per player per hole, to ensure that sufficient game flow is maintained. Despite these rules, some groups ignore the rules or make their own rules, taking more strokes than necessary, slowing down play, and even in groups that do obey the rules, many players waiting their turn get bored and armed with golf clubs and balls, their natural tendency is to use their putter to poke, dig, and hammer away at course features, often damaging them. Golf balls, hit properly and improperly, can easily damage course features. Mini-golf courses feature creative, fanciful obstacles that sustain regular damage by being hit with clubs and balls, requiring regular repair and maintenance by the course owner. Players who get into disputes during play can also deliberately injure one another with balls and clubs, and accidents and damage to property and people by the putters and ball equipment are commonplace. Such behavior creates liability issues for the course owner and unwanted negative publicity, damaging the goodwill of the business.

What is needed is a new toss-skill game that maintains the accessibility of toss-skill games for casual players of every age group while providing a challenging course that maintains player interest. What is also needed is a new toss-skill game that is not easily reproduced at home or in other casual situations and thus will provide course owners a steady revenue stream as a regular, paying attraction for visitors. What is also needed is a new toss-skill game using equipment that eliminates serious personal injury and damage to course property. What is finally needed is a new course-based game that is easily and systematically modifiable by players during play that maintains play speed and the game rules so as to not impact other players, and also providing variation in the game to maintain interest and encourage regular and repeat visitors for the course owner-operator.

DISCLOSURE OF INVENTION

A new toss-skill game played with a toss object on a set course with a plurality of play holes, each play hole having a start and a finish, with a first toss box inside which a player stands located at the start and a target positioned on a raised platform at the finish. A last toss box is positioned between the first toss box and the target. In a representative embodiment, a total of three toss boxes are positioned between the start and the finish of each play hole. Between the start and the finish, the course is further comprised of physical obstacles interfering with a line of sight between the player standing in the toss box and the target, but where there is at least one clear visual line of sight between the first toss box and the target. The physical obstacles may be stationary, moving, or partially or completely obscuring the line of sight and thus require the player to throw the toss object over, under, around or through the physical obstacle. In one aspect of the invention, the physical obstacle is nonvisual and is comprised of persistent or intermittent directed air flow designed to potentially interfere with a trajectory toss object when thrown towards the target.

The toss object is an object that can roll but generally does not bounce and is comprised of beanbags, balls, hacky sack balls, and externally pliable containers filled with one of sand, pelletized material, gel, and water, and combinations of two or more of sand, pelletized material, gel or water.

The target in a first embodiment is configured as a through hole with a toss object receiving inlet and a toss object outlet through which the toss object travels and exits the target. In another embodiment, the target is a visual target upon which a successful thrown toss object rests.

In another aspect of the new toss-skill game, a score card where platform landings of toss-objects are recorded per play hole for the course.

In yet another aspect of the new toss-skill game is a method of play, with the steps of selecting the toss-object per player, moving to a next course play hole, standing in the first toss box of the first play hole, throwing the toss-object towards the target, assessing the toss-object's landing position, moving to a next toss box and throwing the toss-object towards the target if the toss-object failed to reach the target, reassessing the toss-object's landing position, moving to a last toss box if the toss-object's landing position is not the target, calculating the player's score based on whether the number of throws is below or greater than the par for the play hole, repeating the steps of moving, standing, assessing, moving, reassessing, moving and calculating until the last course play hole is played and finished, and calculating a final score by adding up all the scores of each course play hole.

In yet another aspect of the method, the first and last toss boxes are each provided with a foul line behind which the player's feet must remain during the steps of standing and throwing.

In another aspect of the method, the target is a through-hole and the steps of assessing the toss-object's landing position and reassessing the toss-object's landing position are further comprised of visually confirming the toss-object has fully entered the through-hole.

In still yet another aspect of the method, the method is further comprised of marking a score card having at least one indicator space for marking a platform landing of a toss-object arranged by hole and player, and corresponding to a par number per hole using the steps of recording in the indicator space when the toss-object lands on the platform but fails to hit the target per player after the step of assessing and after the step of reassessing. All recorded platform lands per player are marked on the score card, and one stroke is subtracted per three recorded platform lands from the total number of strokes for the course per player.

BRIEF DESCRIPTION OF THE DRAWINGS

The features and advantages of the invention will become apparent from a consideration of the subsequent detailed description presented in connection with accompanying drawings, in which.

DRAWINGS LIST OF REFERENCE NUMERALS

Figure 1:
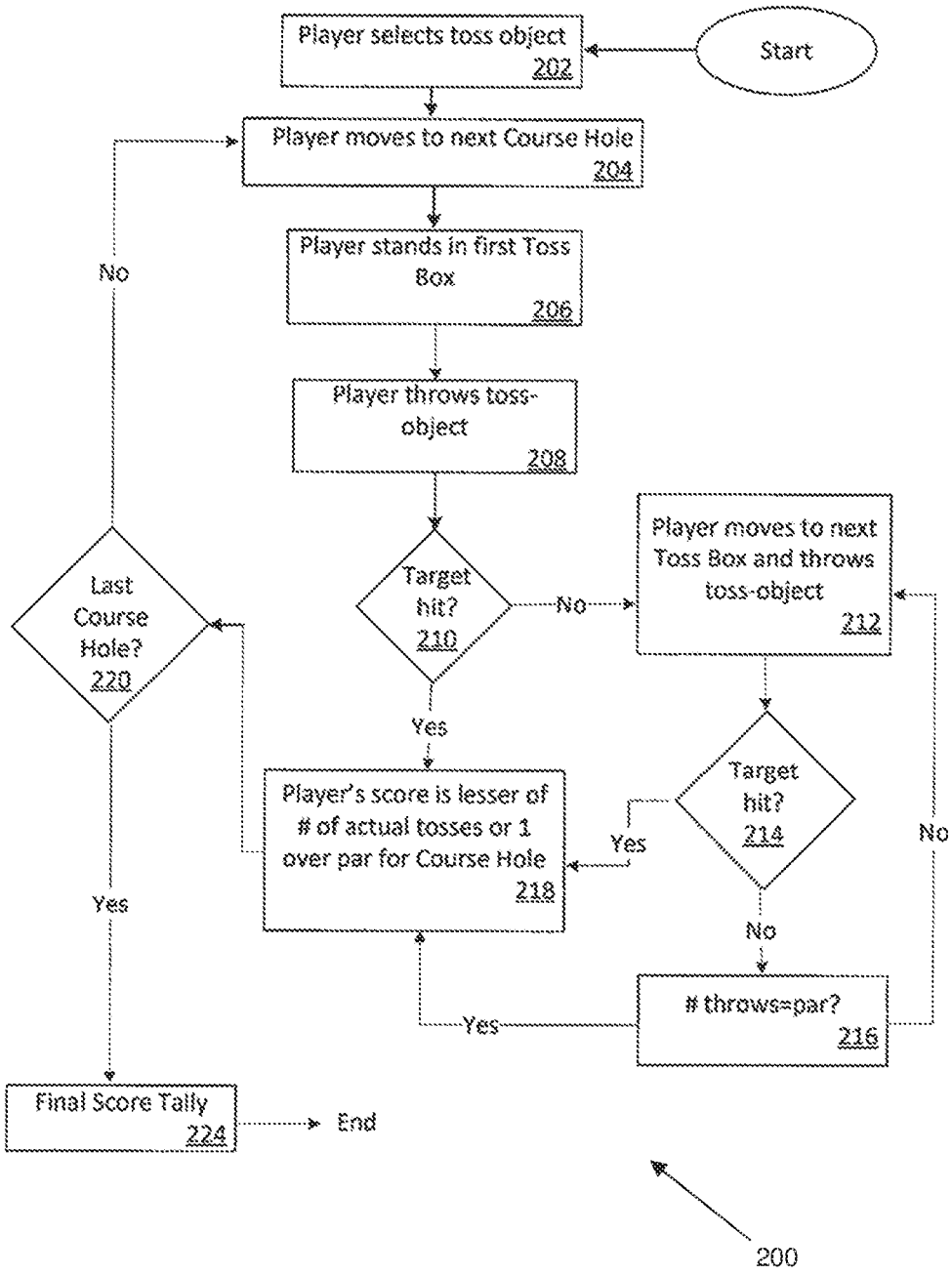
FIG. 1 is a diagrammatic representation of a method of playing a new course-based toss-skill game according to the invention.

The following is a list of reference labels used in the drawings to label components of different embodiments of the invention, and the names of the indicated components.

10 first toss box
12 foul line
14 next toss box
16 last toss box
18 obstacle
18*a* through-hole of obstacle
18*b* toss over feature of obstacle
18*c* moving obstacle
20 hole or target
22 platform
26 toss-object
28 play hole or hole
30 start
32 finish
34 unobstructed line of sight
36 player
40 score card
42 platform landings recording column
42*a* first platform landing of toss-object record
42*b* second platform landing of toss-object record
42*c* third platform landing of toss-object record
42*d* hole 1 score analysis
42*e* hole 5 score analysis
46 player's final score for the course
200 method of play

202 first step
204 second step
206 third step
208 fourth step
210 fifth step
212 sixth step
214 seventh step
216 eighth step
218 ninth step
220 tenth step
224 last step
A distance from first foul line to target of hole
B distance from second or middle foul line to target of hole
C distance from third or last foul line to target of hole

GLOSSARY OF TERMS

Course: Also referred to as a game course. An entire field of play including all individual holes and typically comprising 9, 18 or a custom number of holes positioned in a specific order and fairways of each hole.

Fairway: A field of play for each hole between a start and a finish of the hole.

Hole: Also referred to as a play hole or course play hole. Both a specific type of physical target in some embodiments and a name of one area of the course measured from a start position with a first toss box to a finish position at which the target is positioned.

Obstacle: Includes visual structures and nonvisual challenges. A structure of varying shape and size positioned on the fairway between the toss boxes and the target to make strokes more challenging. The player must choose whether to throw the toss-object over, under, around or through openings formed in the visual structure towards the target. The obstacles at any hole may include structures with portions above a ground surface that move or change position. The obstacles 18 in a fairway are arranged to allow one visual line of sight from the first toss box to the target, with the terms "line of sight" or "visual line of sight" in this disclosure including a trajectory of the toss-object, as once a player establishes line of sight, the trajectory of the toss-object is intended to follow the line of sight. Nonvisual challenges include persistent or intermittent directional flows of air, water or other substances directed through the visual line of sight.

Par: A number of strokes suggested for a hole and based on a total number of toss boxes per hole, typically equaling the number of toss boxes of any given hole. In the representative embodiments shown in the figures, par for the hole is 3 strokes, based on three toss boxes on the fairway.

Platform: An angled or otherwise raised surface surrounding the target near the finish position of each hole. If the target is a through-hole, the platform is further comprised of an inlet at the target, and an outlet positioned below the inlet of the platform oriented generally towards the finish of the hole, where toss-objects enter the target (inlet) and exit the platform through the outlet, where the toss-object is deposited on the fairway usually behind the platform, or in a toss-object receptacle below the outlet.

Stroke or Throw: Each attempt to throw the toss-object. In the representative embodiment shown in the figures, the stroke limit is 3 per hole, based on one toss per toss box of the hole.

Toss-object: a bag, sack, ball or similarly small object sized and shaped to be held in a player's hand, easily thrown, and must be smaller than a target of the hole. The toss-object may roll but ideally bouncing is minimized. The toss-object typically must be able to absorb impact forces when it makes contact with obstacles, platforms and targets to minimize bounce.

DETAILED DESCRIPTION

Figure 2:
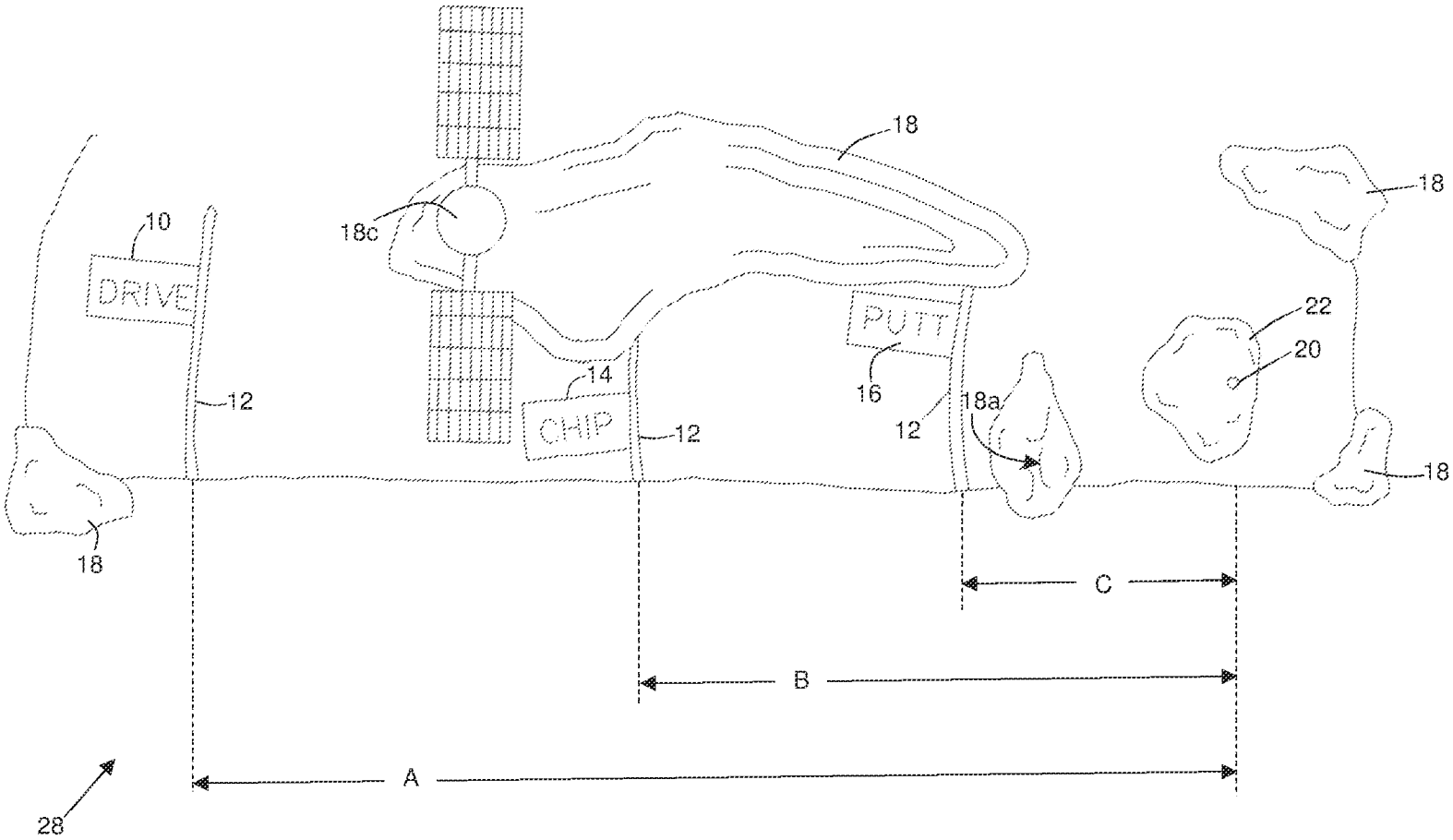
FIG. 2 is a top view of a diagrammatic representation of one representative hole of a plurality of holes comprising a course of the new game in FIG. 1.
Figure 3:
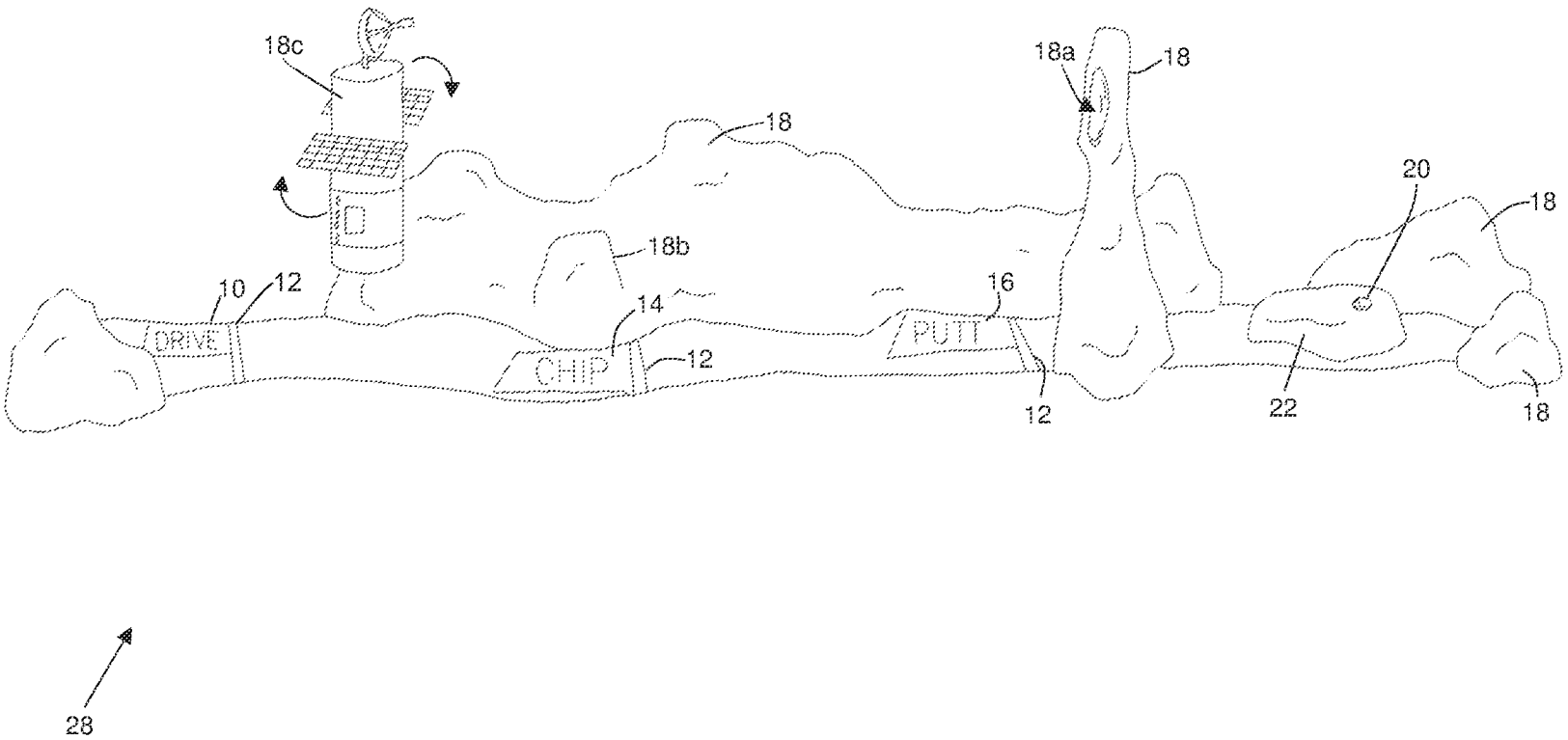
FIG. 3 is a side view of the one representative hole in FIG. 2, showing a plurality of obstacles and toss boxes.
Figure 4:
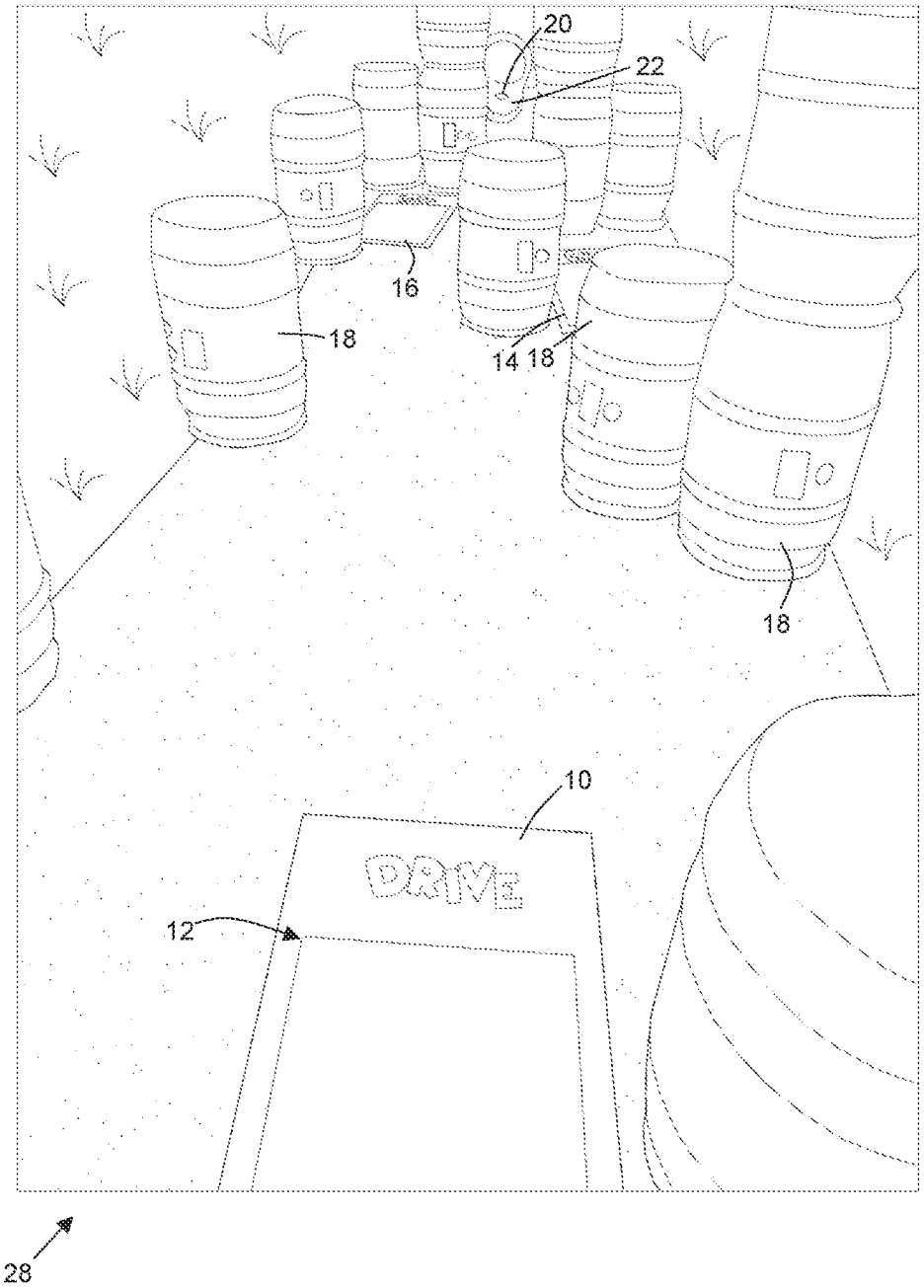
FIG. 4 is a first front view of a second representative hole of the plurality of holes comprising the course of the new game, taken from the viewpoint of a player, showing a sight line from a start to a target of the second representative hole and the plurality of obstacles and toss boxes.
Figure 5:
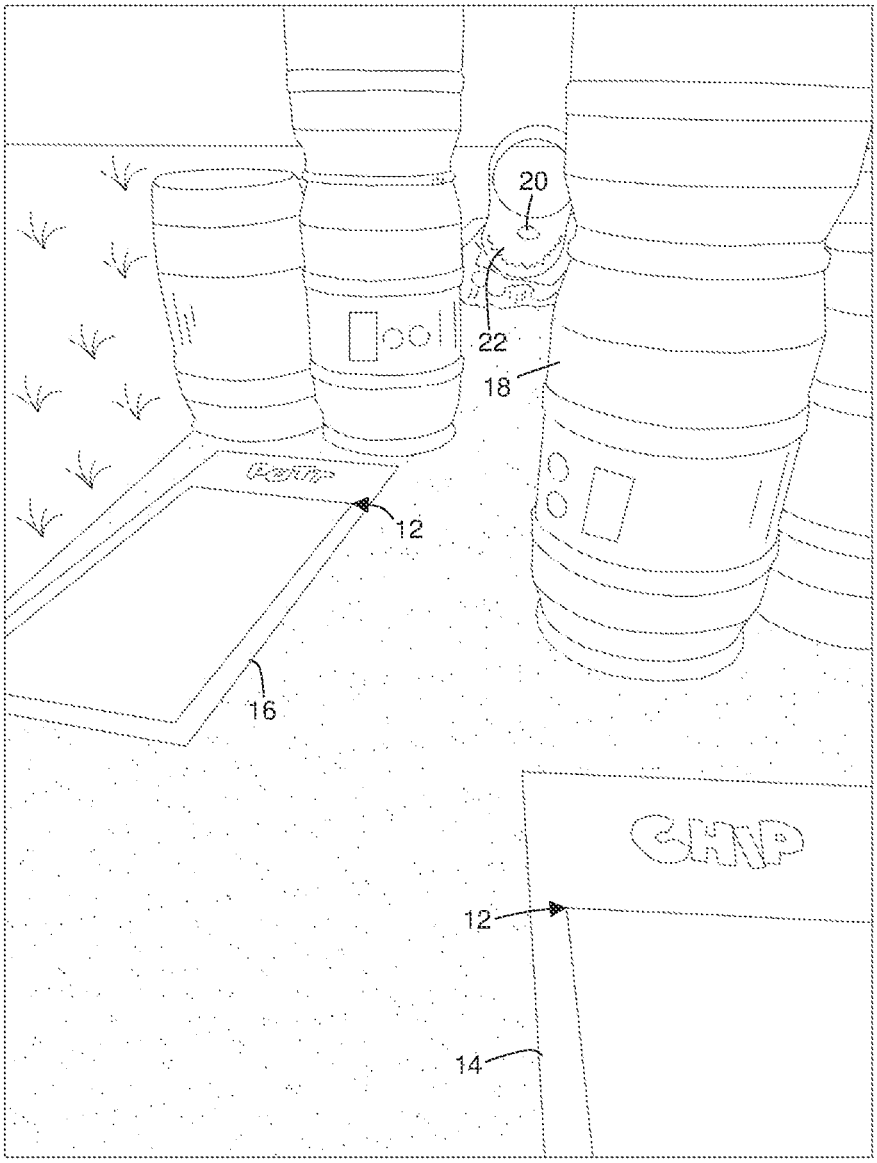
FIG. 5 is a second front view of the second representative hole of the plurality of holes comprising the course of the new game, taken from the viewpoint of the player near the middle and last toss boxes of the hole.
Figure 6:
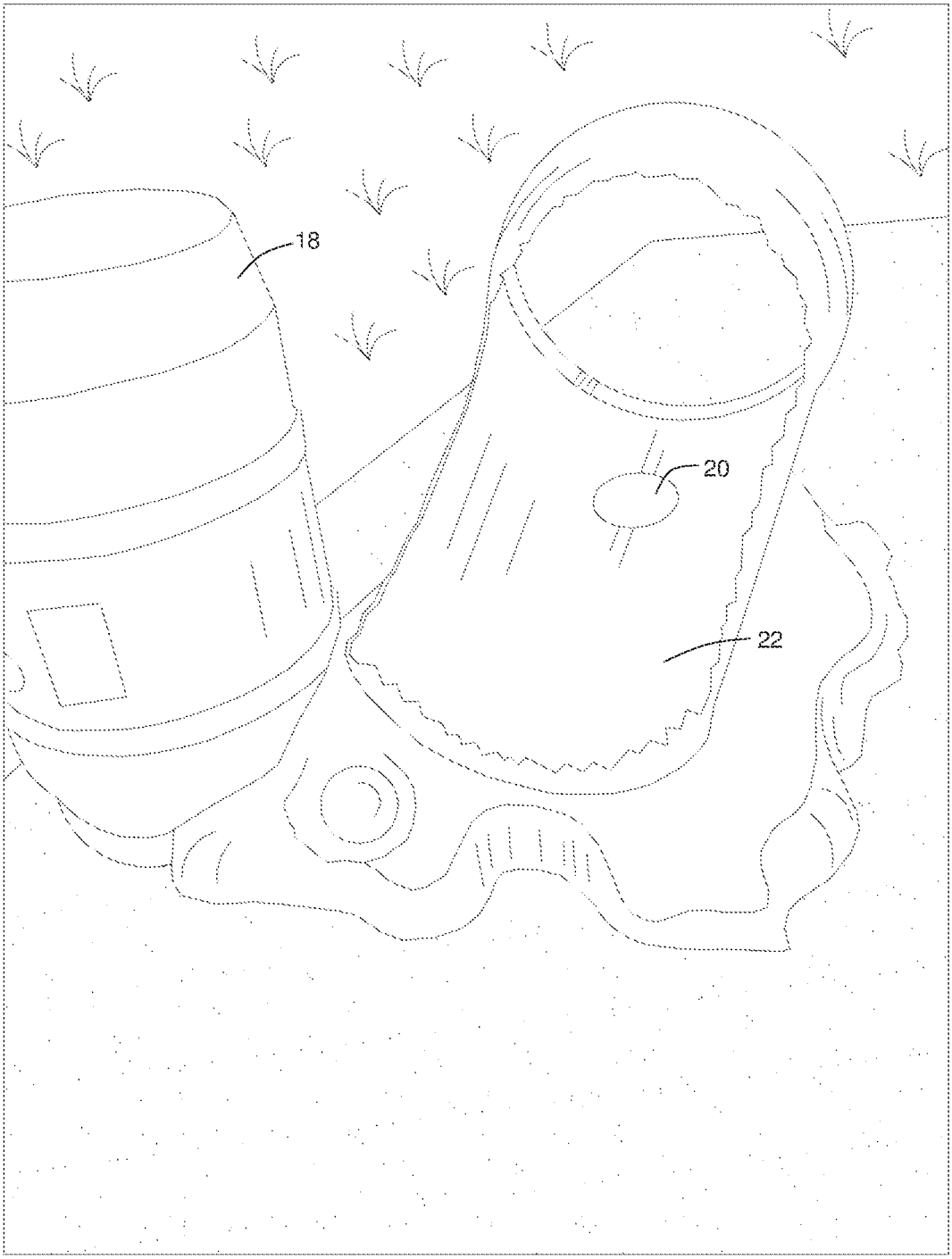
FIG. 6 is a front view of a target of the second representative hole of the plurality of holes comprising the course of the new game, showing the target on a platform near a finish of the hole.
Figure 8:
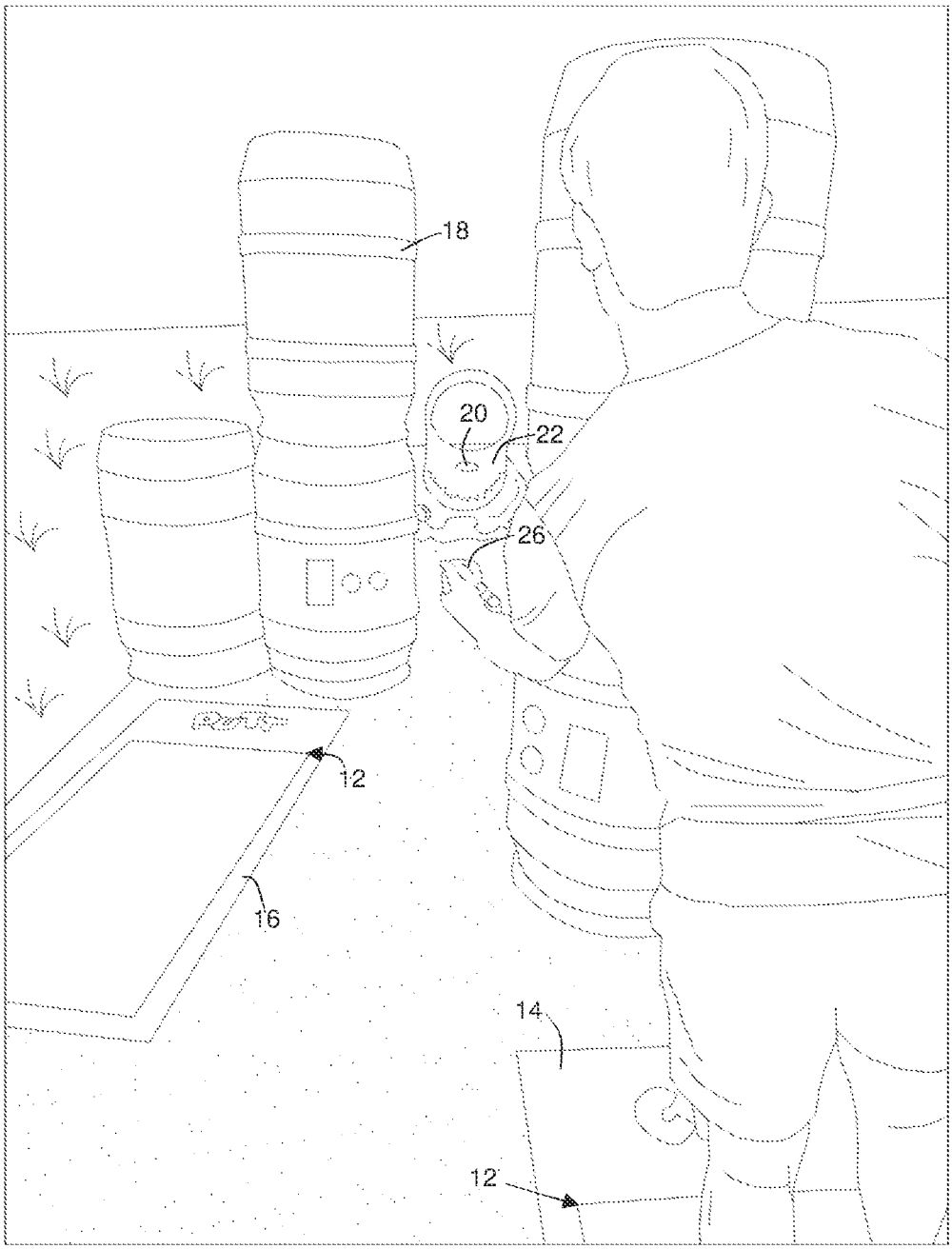
FIG. 8 is a back perspective view of the player in FIG. 7, showing the second representative hole and the line of sight from the first toss box to the target.
Figure 9:
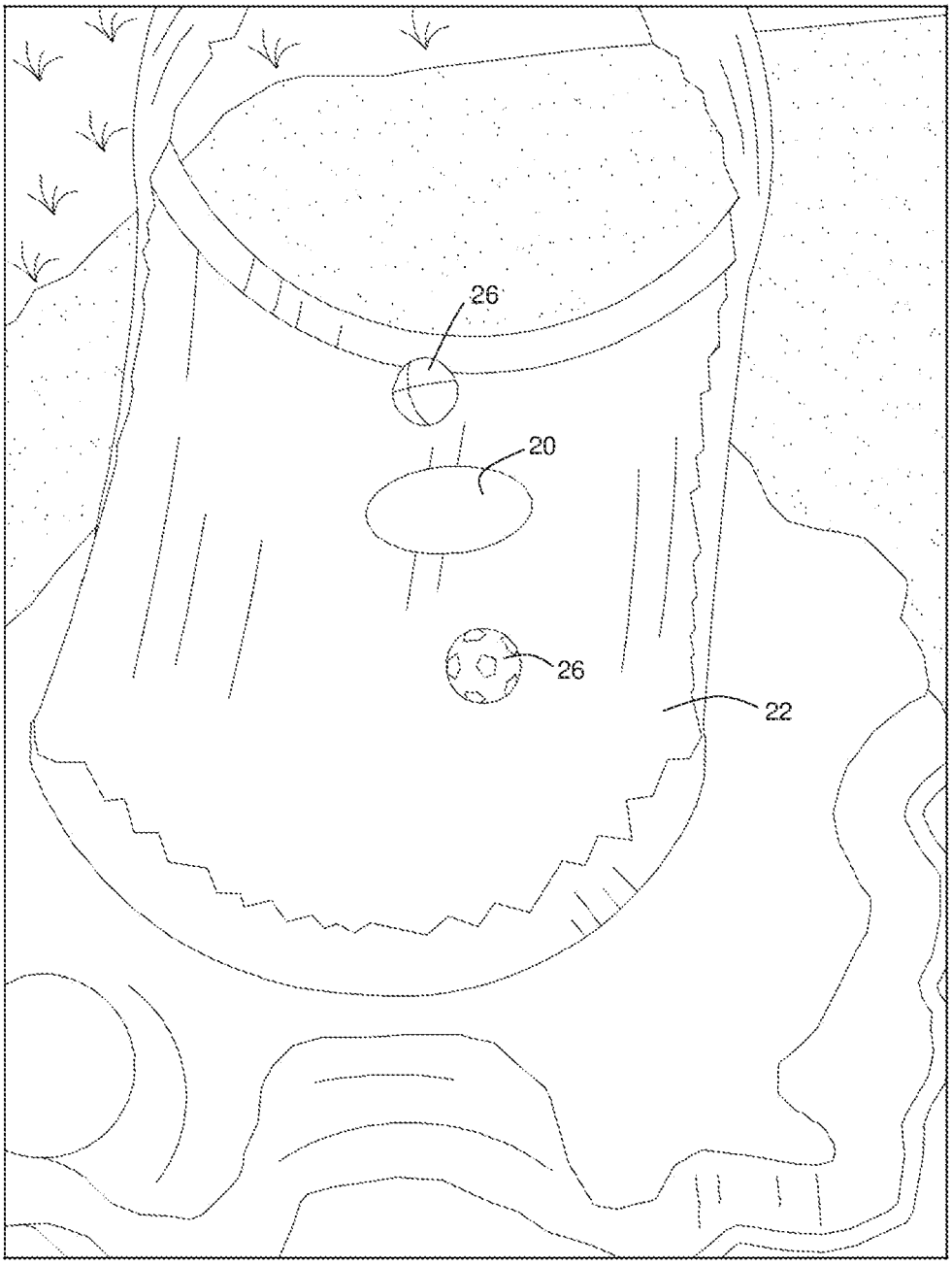
FIG. 9 is a front perspective view of the platform and the target, shown with a plurality of toss-objects around the target.
Figure 10:
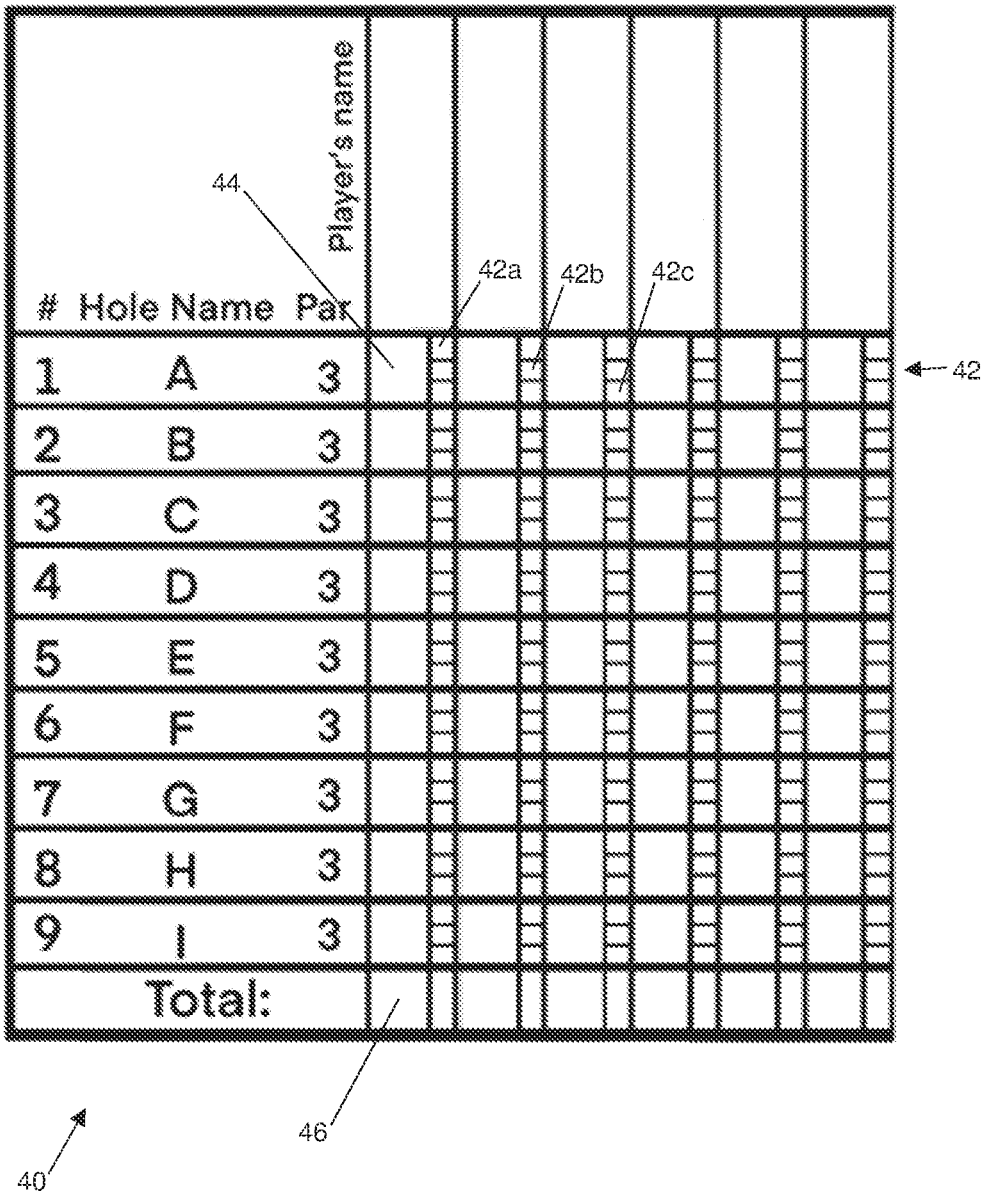
FIG. 10 is a diagrammatic representation of a score card used with the new game, shown as it would appear prior to use.
Figure 11:
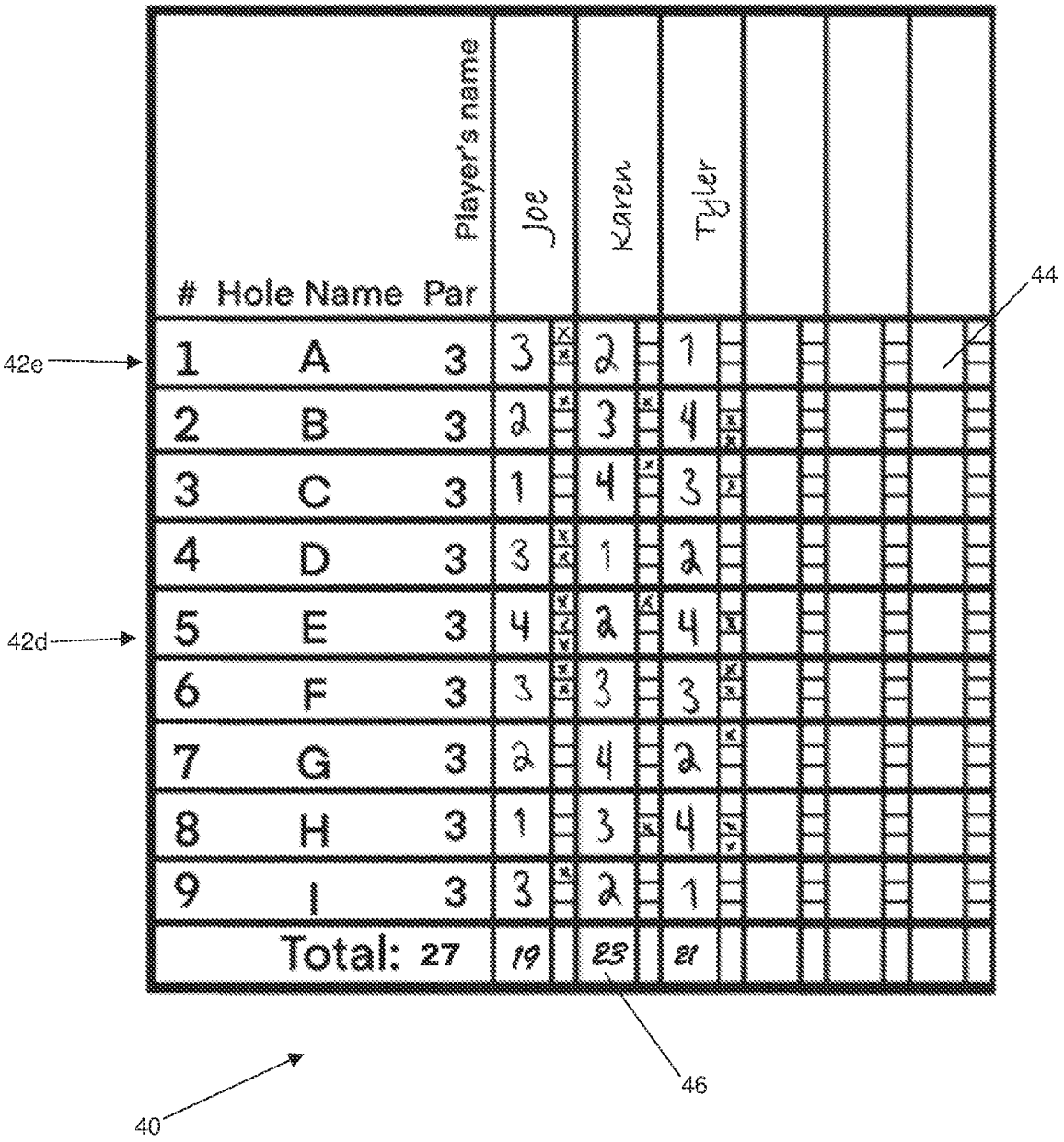
FIG. 11 is a diagrammatic representation of the score card in FIG. 7, shown as it would appear while used with the method described in FIG. 1.

A new course-based toss skill game according to the invention or new game is comprised of a game course or course having a plurality of holes, with a first representative hole described in FIGS. 2-3, a second representative hole described in FIGS. 4-9, and a method of play 200 on the course described in FIG. 1 and in FIGS. 10-11 where one embodiment of a score card 40 is diagrammatically shown in an unused and used embodiment. The inventor notes that the representative embodiments of his new game in the figures is not meant to be limiting but rather to illustrate more clearly one example of how the method 200 and course are implemented. The representative embodiments in the figures are also not drawn to scale, again because they are illustrative only of some of the ways in which the assembly and method can be practiced.

An objective of the new game is to toss or throw an object or toss-object 26 and hit a target 20 at each play hole or hole 28 of the plurality of holes on the course. The toss-object 26 is a ball, sack, bag, ring or similarly sized and shaped object that is hand-held and that can be easily thrown to hit the target 20. The toss-object 26 can roll, but ideally does not bounce and is flexible, with a shape that is conformable to a shape of a structure upon which it lands and thus is not a hard object such as a baseball or golf ball. A typical toss-object 26 is beanbag or hacky sack ball filled with beads, beans, water, gel, sand, or other conformable material. The course visually is reminiscent of a miniature or mini-golf course in terms of layout, and golf terms, such as those appearing in the Glossary section of this disclosure, are used throughout the new game and course to provide a player 36 a "golf-adjacent" experience with familiar terms and a course visually mimicking a mini-golf course, although the terms are used differently than as used in golf and mini-golf, and while visually the course is reminiscent of a mini-golf course, there are significant differences in the course and equipment upon closer inspection.

The course is comprised of the plurality of individual play holes or holes 28 in a set order. Each hole 28 is further comprised of a first toss box 10, one or more next toss boxes 14, and a last toss box 16. The next toss boxes 14 are always positioned between the first toss box 10 and the last toss box 16. The first toss box 10 is positioned at a start 30 of each hole 28, with the last toss box 16 positioned before the target 20 and a finish 32. The target 20 is typically configured as an actual through-hole formed in a platform 22 at the finish 32, where the through-hole has an inlet, which is the target 20 and an outlet, which is typically positioned below a surface of the platform 22 and below the horizontal plane of the target 20, such that a toss-object 26 that enters the target 20 exits the platform 22 at the outlet, which then deposits the toss-object 26 on the fairway or into a receptacle positioned underneath the outlet for collecting the toss-object 26. The platform 22 is typically an angled or otherwise raised structure from a fairway ground surface with an uppermost surface that is relatively planar, concave, domed or otherwise irregularly configured, and when configured with the through-hole, the inlet-outlet arrangement and structure are similar to that of what is found in a cornhole board. The toss-object 26 is capable of landing near or rolling towards the target 20, but generally not bounce when it contacts the platform 22.

Each toss box 10 14 16 is formed with a foul line 12, which may be a line at a front end of the toss box 10 14 16, as shown in FIGS. 2 and 3, or is simply a front end of a visually designated standing area within each toss box 10 14 16 as shown in the second representative hole in FIGS. 4-9. The foul line 12 is simply the line behind which the player 36 must stand when throwing the toss-object 26. A line of sight 24 from the first toss box 10 to the target 20 exists to allow the player 36 the possibility of throwing the toss-object 26 and hitting the target 20 with a single throw. The term "line of sight" includes a trajectory of the toss-object, and these terms are interchangeable in this disclosure. The inventor notes that when the line of sight is established, an ideal trajectory of the toss-object is in fact the line of sight, and moving obstacles 18*c* can interfere with the trajectory as well as the line of sight. Each throw is called a stroke, to borrow golf terminology, and each hole 28 of the plurality of holes in the representative embodiments shown in the figures is a par 3, meaning that there are 3 strokes (throws) per hole 28 based on three toss boxes 10 14 16 per hole 28.

The inventor notes that for some courses, each hole 28 may have more or fewer toss boxes than three and thus the course owner can build a course varying the par to incorporate certain land or space constraints that otherwise would make a required par three per hole difficult to achieve. The course thus may have several par 3 holes intermixed with some par 2 holes, for instance. A hole in one is a single throw hitting the target 20. If the hole has three toss boxes, par is three strokes (throws); if the player 36 makes three throws and the toss-object 26 has not hit the target 20, the player's score for the hole is now 4 strokes (throws) and the player 36 proceeds to a next hole 28 of the plurality of holes of the course. This ensures that play is not delayed and keeps the play moving. Use of the toss boxes 10 14 16 and foul lines 12 speed up play, which tends to limit player boredom when groups are playing as this minimizing waiting times. Player boredom while waiting for others to play is a common known issue with mini-golf and golf, and slow players can cause arguments, annoyance, and course damage by waiting players. While the course owner for the new game will no longer deal with putters destroying obstacles 18, stopping bored players 36 from sitting or jumping on obstacles 18 is difficult to prevent, and maintaining game play speed is the best way to avoid course damage by players 36.

The inventor notes that obstacles 18 can also be designed to minimize jumping, climbing, sitting, etc. by waiting players by designing the obstacles 18 to be less than inviting to touch, by making them prickly, slippery, or otherwise not easily scalable. While this can also be done with mini-golf courses, since the golf balls are inherently dangerous, the goal of the mini-golf course owner is to keep play near the ground surface, so incorporating taller elements in the fairway is not needed and just creates more maintenance headaches by encouraging players to try to hit the ball through tall openings, or over certain fairway features, and thus invite damage and mischief.

Figure 7:
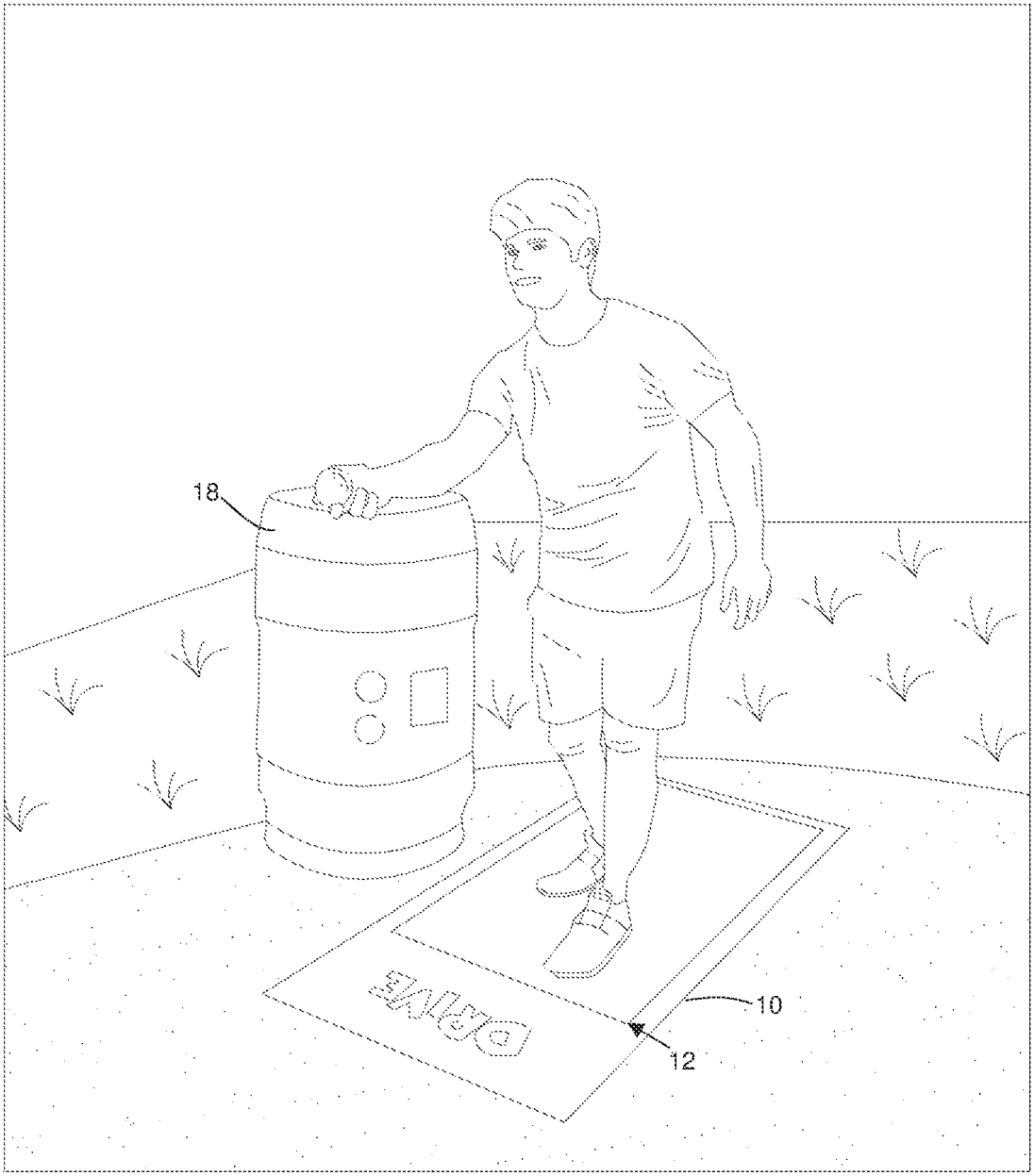
FIG. 7 is a front perspective view of the player standing at a start of the second representative hole, in a play position and holding a ball chosen as a toss-object.

One advantage of the new game is that the selection of the toss-object 26 can change the play of the new game. A typical distance A of the fairway of each hole 28, measured approximately from the foul line 12 of the first toss box 10 to the target 20 20*a* at about 30 feet, with a typical distance B of the fairway from the middle toss box 14 to the target 20 20*a* is about 18 feet, and the last distance C from the foul line 12 of the last toss box 16 to the target 20 20*a* is about 10 feet. However, note that these distances A B C are approximate and can vary from hole to hole and thus the fairway of a first hole may be different from that of a fourth hole, etc. In FIGS. 7-9, the toss-object 26 is a ball, and again, ideally is weighted to ensure it can be thrown the distances A B C required but not be so heavy or hard as to be capable of damaging the obstacles 18 or other players. The inventor notes that using beanbags and hacky sack balls instead of clubs and golf balls greatly diminishes damage to people and property during game play and bored players are not armed with a club that can cause serious damage. A bean bag thrown at another person rarely can cause injury, and the inventor believes that use of such toss-objects 26 will minimize damage to the course and thus reduce costs and operational headaches for the course owner.

Another advantage to the new game described herein is that since the toss-objects 26 are not continuously touching the fairway, there is no need for the course owner to maintain "greens", which in the case of mini-golf is often a carpet-like material that is designed to mimic grass in real golf. This material is subject to weathering and wear use and thus must also be maintained. In contrast, since the new game does not require a "green", the fairway itself can be easy to maintain concrete, and surficial issues such as cracks do not hinder play, compared to issues with the "greens" material on a mini-golf course, where tears and worn spots hamper play.

The inventor notes that the representative holes 28 shown in the figures are illustrative only, and that the obstacles 18 for any hole 28 are arranged so that the player 36 has to throw the toss-object 26 around, through, over or under the obstacles 18. In FIGS. 2 and 3 for instance, there is an obstacle 18 with a through-hole 18*a* sized to allow the toss-object 26 to pass through, and a toss over obstacle 18*b* that requires the toss-object 26 to be thrown over the obstacle 18*b* in order to hit the target 20. In the figures, the obstacles at each hole 28 may follow a theme, such as barrels shown in FIGS. 7-9, or rocks such as is shown in FIGS. 2-3. Obstacles 18 can be stationary or constantly or intermittently in motion, to provide more or less challenge to the player 36. The obstacles 18 can also be nonvisual, such as intermittent or persistent streams of air directed in the line of sight that can redirect the toss object and thus increase the challenge to the player. Note that in mini-golf, any moving obstacles are designed to interfere with a rolling ball, but for the present invention, moving obstacles 18*c* such as shown in FIGS. 2 and 3 are designed to interfere with the line of sight from the toss boxes 10 14 16 either intermittently or persistently, and thus are positioned relatively further above the ground surface than any moving obstruction in a mini-golf game. Themed courses are possible with the obstacles 18, such as the outer space theme shown in FIGS. 2-3, and thus serve as special attractions for the public to enjoy. Unlike mini-golf, where game play is always the same, the use of different toss-objects 26 changes the play of the new game, and two players in a same group can choose different toss-objects 26 to mix up the new game as desired. The target 20 can be a through hole, a visual target only where the toss-object 26 has to land on the target 20, or any other target 20 configured for the toss object 26. In a typical game play, players 36 choose the toss-object 26 at the start of the game and use the same toss-object 26 for the entire game, however in other variations, new toss-objects 26 can be selected at every hole played if desired or offered by the course owner.

The ability to change up the new game is advantageous to the players 36 who are thus never bored and can create their own game variations without impacting other players 36, and to the course owner, who can offer a fast-paced game with many variations that keeps the experience fun and fresh. It is human nature to seek out new experiences, and the ability of the new game to change without requiring expensive physical renovations is another advantage to the course owner, who can offer up a variety of different and inexpensive toss-objects 26. The inventor notes that while he is providing examples of toss-objects 26 such as beanbags, there is no reason why other objects with similar characteristics cannot be used, such as water or gel-filled objects, rubber ducks, pellet-filled stuffed animals, baby shoes, socks, etc. that would allow for fun holiday themes and other variations. One variation could be that toss-objects 26 at each hole 28 are blind selected from a bin of toss-objects 26 at the start 30 of the hole 28, where the players 36 reach into the bin and grab the toss-object 26 for use at that particular hole 28. There are countless variations on game play for the toss-objects 26. The differences in toss-objects 26 naturally increases or decreases challenge to the players 36, since constant use of a same toss-object 26 would over time condition the player's skill with that toss-object 26 but varying the toss-objects 26 eliminates "training" and keeps the new game casual and challenging for all players. The inventor note that other toss-skill games, mini-golf and golf itself have fixed equipment and thus subject to players becoming more trained and skilled through regular practice. Also, the lack of variation in the equipment in the prior art games again decreases novelty in the game. The inventor notes that for mini-golf, for instance, the only variation in the equipment is the club size and ball color, and some mini-golf course owners have tried to increase novelty and thus regular paying visitors by creating blacklight courses, and doing regular, expensive renovations of fairways to keep visitors coming back. The new game thus provides novelty with little expense to the course owner.

The inventor also notes that using a putter and ball requires significantly more hand-eye coordination than throwing a beanbag, and thus his new game has a low skill threshold, allowing players of all ages to enjoy his new game. Challenge is provided by the obstacles 18, the distances A B C along the toss boxes 10 14 16 and the fairways. The inventor stresses that the line of sight 24 at each hole 28 must be such that a hole in one is always possible at each hole 28 of the course, as this is the ultimate skill test and providing different toss-objects 26 increases the challenge of repetitive holes in one. The inventor envisions his new game will encourage competitions where players with low handicaps can be further challenged by using toss-objects 26 of varying shapes, sizes and weight distribution. A typical beanbag used in cornhole, for instance, and readily available for purchase is about 16 oz, but the toss-objects 26 according to the new game may have toss-objects that weight more or less than 16 oz or can vary in weight. For instance, a younger player or a player over 65 might prefer a lighter weighted toss-object 26.

Turning to FIG. 1, the method of playing the new game 200 is shown. Step one 202 starts with the player 36 selecting the toss-object 26 to use during play. Each player's toss-object 26 can be a same object throughout the entire course, or different at each hole, as desired. Step two 204 has the player 36 moving to a next course hole 28 in the course, which at a beginning of play is a first hole 28 and proceeds in play order from the first hole 28 to the last hole 28. In some game variations, the players 36 may skip holes 28, but this may cause play flow issues and the inventor believes to maintain play flow the holes 28 are played in order without missing any holes, or if holes are skipped or otherwise played in a different numerical order (that is, not proceeding from hole one to hole two, etc. but rather for example proceeding from hole one to hole three then to hole eight) when all course players 36 follow this same order, as might be done during a scheduled tournament. Step three 206 has the player 36 stand inside the first toss box 10, which in the figures is marked as "drive". The player's feet and body must be behind the foul line 12 to ensure that the distances A B C from the foul lines 12 at the first, next and last toss boxes 10 14 16 to the target 20 are consistent for the players 36. Step four 208 involves the player 36 throwing or tossing the toss-object 26 towards the target 20. Given that the obstacles 18 may obscure the player's view of the target 20 at some heights, the player 36 may have to stoop, bend or twist while standing in the toss box to secure the line of sight 24 from the toss box 10 to the target 20. In Step five 210, the player's stroke (throw) is assessed. Did the toss-object 26 land on the target 20? If yes, in a step nine, the player's score is the lesser of the number of actual throws or par for the hole and then marked on a scorecard 40, as shown in FIGS. 10-11. In the representative holes shown in the figures par is 3 strokes (throws). Hence if the throw is the player's first throw, then the player's score is 1, if it is the player's second throw, then the player's score is 2, if it is the player's third throw, then the player's score is par (that is, 3 strokes). If the player's throw is a first stroke (throw), and fails to hit the target 20, in a step six 212, the player 36 moves to the next toss box 14, shown in the representative holes in the figures marked as "Chip" and again throws the toss-object 26, with a step seven 214 another assessment of whether the target 20 was hit successfully. If successful, the player 36 proceeds to step nine again, or if unsuccessful, to step eight 216, where the number of throws is assessed based on whether it is greater than or equal to par. If the answer is yes, the player 36 proceeds to step nine, and if the answer is no, the player returns to step six 212 and moves to the next toss box 16, in the representative hole marked as "Putt" and tries throwing again. Once the player 36 has finished the hole 28, the player goes to step ten 220, where an assessment is made as to whether the next hole is a last hole of the course or not; if not, the player 36 repeats steps two to nine, until step ten 220 is indeed the last hole of the course, where in a last step 224, the scores of all holes 28 are tallied for each player 36 and a winner is the player 36 with a lowest score or number of strokes (throws). A lowest possible score for a player of any course is where the player had a stroke total of one per hole.

The scorecard 40 in FIGS. 10 and 11 has a series of toss-object 26 platform landing recording boxes **42*a* 42*b* 42*c* arranged in a column 42, the total number corresponding to the par for the respective hole 28. The scorecard 40 shown in FIGS. 10-11 is for a course where all holes are par 3; note that holes in a course can be anything from below or above par 3 and a same course can have hole with par 1, par 3, par 5 etc., which will be indicated on the score card 40. In the sample used score card 40 in FIG. 11, three players 36** are listed as Joe, Karen and Tyler on the card.

In FIG. 11, looking at Hole 1, Joe has a score of 3 for the hole **42*e*, along with two of the toss-object 26 landing indicators 42*a* 42*b* marked with an X. Joe threw his toss-object 26 twice, each time the toss-object 26 failed to reach the target 20 but hit the platform, while Karen and Tyler continued to take their turns at their respective toss boxes 10 14 16. Joe's score is 3, meaning that his third total stroke (throw) taken at the last toss box 16 marked "Putt" hit the target 20**. For that same hole, Karen has a score of 2, meaning that she took two throws total, and her toss-object 26 did not land on the platform 22 at all, but she managed to get her toss-object 26 to the target 20 in 2 total strokes (throws). Tyler, meanwhile has a score of 1 and thus he threw his toss object once and hit the target 20, thus there are no Xs denoting his toss-object 26 hit the platform 22 but not the target 20.

For hole 5 42*d*, Joe has a score of 4 and all three platform landing indicator boxes 42*a* 42*b* 42*c* have Xs in them. This means that his toss-object 26 landed on the platform 22 3 times, but failed to hit the target 20. His score is thus 4, which corresponds with method step nine 218 in FIG. 1, where in such an instance the player's score is 1 over par, or alternatively in other game variations, the actual number of strokes (throws) needed for the toss-object 26 to hit the target 20. Karen's score is 2, with one platform landing indicator 42*a* marked with an X; this means that she did two total throws, and her first throw hit the platform 22 but did not hit the target 20 but her second throw hit the target 20. Tyler's score is 4, and the second platform landing indicator 42*b* has an X. This means that Tyler's first and third throws did not hit the target, nor did they land on the platform 22, and his second throw landed on the platform 22 but failed to hit the target 20. He took at least 3 total throws, never hitting the target 20 and thus his score is 4, which is one over par.

In the last step 224, when the final scores are tallied, each player deducts 1 stroke from their final score for every 3 X marks in the platform landing indicators 42*a* 42*b* 42*c*. Turning to FIG. 11, Joe has a total of 22 strokes, but 11 X marks and thus must deduct 1 stroke from the total number of strokes for every 3 X marks, meaning his final score is 19, rather than 22. Karen has a total of 24 strokes and 4 X marks, so she deducts 1 stroke and her final score is 23. Tyler has a total of 24 strokes and 9 X marks, so he deducts 3 strokes and his final score is 21.

The inventor specifically wants to point out that his new game is neither "mini-golf" nor "cornhole" and notes the following specific differences:

Cornhole has two opposed angled, planar boards with through-holes and play is bidirectional, meaning that players move from one side to another to throw beanbags into the holes of the boards. There are no obstacles or other visual obstacles. There is no set course. Once play starts, the boards do not move and neither do the players. The equipment is standardized and never changing. Each player has 4 beanbags and 4 tosses per turn. Cornhole requires the players to stand in a same position when throwing multiple times at a same target. There is no score card and a player wins by being the first one to achieve 21 points.

In contrast, the inventor's game is played in one direction only, on a set course with obstacles that interfere with play, and can use a variety of different toss-objects, including balls, rings and other things. The course features also change from course to course and hole to hole. There is only one "board", which is a raised platform that can be planar, cupped, irregularly shaped or otherwise and the target may or may not be a through-hole. Players moved from position to position while throwing at a same target.

Mini-golf always uses ball and putter equipment, and the target is always a hole with a fixed bottom. The ball is designed to roll on the fairway, which is a "green" that in mini-golf is created by using artificial turf or carpet to simulate grass. The ball is never touched by the player's hands except to tee off and retrieve the ball from the hole. Mini-golf features set courses with a variety of obstacles that functionally are designed to be engaged by a rolling golf ball and thus interfere with the forward motion of the golf ball and thus are low to the ground or at a ground level. The obstacles can be ramps, hills, and intermittent obstacles, like the ubiquitous windmill with the arms blocking and unblocking an access hole or ramp for the ball. All of these require the ball to roll on the fairway and interact with the obstacle at the ground level.

In contrast, the inventor's new game has only toss-objects, and the toss-objects are handled only by the player's hands and only thrown, never kicked, putted, etc. The target can be a painted target or a through hole where the toss-object falls to the ground outside the platform 22. The inventor's new game has obstacles 118 that are designed to interfere with the toss-object 26 that is thrown through the air, and thus the obstacles serve are projectile interference obstacles that are designed to force the player to throw the toss-object around, through, under and over the obstacle. The height of these obstacles vary between holes and within the fairways of each hole, since the toss-object does not touch the fairway when thrown, and the only contact is when the toss-object lands anywhere except at the target 20. There are no "greens" since the toss-object 26 doesn't need a special surface upon which to travel. The inventor notes that the only similarity between mini-golf and his new game is that there is a set course with a number of fanciful obstacles and other features, but upon closer examination, the courses are also different because they are designed for different games with different equipment and rules of play.

It is to be understood that the above-described arrangements are only illustrative of the application of the principles of the present invention. Numerous modifications and alternative arrangements may be devised by those skilled in the art without departing from the scope of the present invention. The inventor's new game is easily modified, with play variation and skill challenge variations deriving from the player's choice of different toss-objects 26, a feature that is not present in any prior-art toss-skill game, mini-golf game, or the game of golf itself. This ability to easily vary the skill and experience of the game without slowing the game play or otherwise changing the game rules supplies novelty to the game that attracts repeat players to the set course and thus improves course owners' bottom lines. The representative holes shown in the figures, including the visual representations of the obstacles 18 is meant to be illustrative only and not meant to limit the creativity of the obstacles 18 that are suitable for use with the new game. The inventor notes that sound and light features can be incorporated into the obstacles or into the game experience, and in particular, holes 28 can feature timing elements that are either manually set by the players or automatically started when a player is sensed in the first toss box 10, where sounds, lights or other signaling means are used to alert the player as to time limits per toss box, or for the entire hole to help further enhance game flow and minimize boredom. To the inventor's knowledge, such timing features are not incorporated into set courses of any golf or mini-golf course, and is more left to the choice of the players. Incorporating timing features into the set course further ensures game flow is maintained, and further challenges the players 36 in a low cost way.

I claim:

1. A new toss-skill game apparatus, comprising:

a course having a first play hole and a terminal play hole, each of the first and terminal play holes defined between a start and an opposed finish in spaced apart relationship by a predetermined distance equal to or less than 30 feet;

a first toss box positioned at the start of the first play hole;

a last toss box positioned between the first toss box and the finish;

a target positioned at the finish;

a toss object; and a physical obstacle positioned between the first toss box and the target;

wherein each of the first toss box and the last toss box is further comprised of a foul line;

wherein the physical obstacle is sized and positioned relative to the first toss box and the finish such that the physical obstacle obstructs a plurality of straight-line visual paths from the first toss box to the target while leaving unobstructed one straight-line visual path from the first toss box to the target through a gap in the physical obstacle to the target;

wherein the physical obstacle is either a barrier structure, a moving assembly, or a localized airflow barrier generated by an air-jet generator; and wherein the toss-object is either a beanbag or another pliable, conformable container filled with either sand, pelletized material, water, gel, or combinations thereof.

2. The new toss-skill game apparatus in claim 1, wherein the target is a through-hole with an entry positioned on a raised platform at the finish of the first play hole of the course, and an exit below the raised platform, the through-hole sized and shaped to receive the toss-object such that the toss-object enters the through-hole and exits below the platform.

3. The new toss-skill game apparatus in claim 1, wherein the toss-object weighs no more than 16 ounces.

4. The new toss-skill game apparatus in claim 1, wherein the physical obstacle is further comprised of a motor-driven assembly that rotates or oscillates to intermittently align the gap with the one unobstructed straight-line visual path from the first toss box or the last toss box to the target.

5. The new toss-skill game apparatus in claim 1, further comprising a score card where platform landings of toss-objects are recorded per play hole for the course.

6. A method of playing a new toss-skill game by a player using the apparatus of claim 1, comprising the steps of:

standing in the first toss box of the first play hole with both feet of the player behind the foul line;

hand-tossing the toss-object towards the target through the identified unobstructed one straight-line path;

assessing whether the toss-object followed the unobstructed one straight-line visual path from the behind the foul line to the target by confirming the toss-objected entered the target;

advancing to the next toss box and repeating the steps of standing, hand-tossing and assessing if the toss-object failed to enter the target or advancing to a subsequent play hole if the toss-object entered the target;

repeating the steps of advancing, standing, hand-tossing, and assessing for each subsequent play hole of the course until reaching the finish of the terminal play hole.

7. The method in claim 6, wherein the step of assessing the toss-object's landing position is further comprised of the step of:

confirming the toss-object exited below the platform after the step of assessing and before the step of advancing.

8. The method in claim 6, wherein the toss-object is a beanbag.

9. The method in claim 6, further comprising:

providing a score card having a plurality of indicator spaces, each indicator space of the plurality of indicator spaces associated with a respective play hole and player for marking a platform landing of the toss-object by each player, and corresponding to a par value per respective play hole; and recording a corresponding indicator space to record when the toss-object lands on the platform but fails to enter the target;

wherein the step of marking is performed after the step of assessing and before the step of advancing.

10. The method in claim 9, further comprising the steps of:

adding all recorded platform lands per player on the score card; and subtracting one stroke per three recorded platform lands from the total number of strokes for the course per player.

11. The method in claim 6, wherein the physical obstacle comprises the moving assembly and the step of hand-tossing includes timing the hand-toss to align with the intermittent gap created by in the moving assembly in the unobstructed one straight-line visual path.

* * * * *